United States Patent [19]

Higgins

[11] Patent Number: 4,625,349

[45] Date of Patent: Dec. 2, 1986

[54] BEDDING COIL SPRING UNIT AND ASSEMBLY METHOD

[75] Inventor: Larry Higgins, Carthage, Mo.

[73] Assignee: Leggett & Platt, Incorporated, Carthage, Mo.

[21] Appl. No.: 721,575

[22] Filed: Apr. 10, 1985

[51] Int. Cl.[4] ..... A47C 23/02; A47C 27/04

[52] U.S. Cl. ..... 5/248; 5/256; 5/268; 5/475

[58] Field of Search ..... 5/246–248, 5/255, 256, 267, 268, 464, 475, 476; 267/91, 93, 95, 97, 101, 103, 105, 106

[56] References Cited

U.S. PATENT DOCUMENTS

| | | | |
|---|---|---|---|
| 277,121 | 5/1883 | Davis | 5/268 |
| 1,372,129 | 3/1971 | Foster | 5/256 |
| 2,137,298 | 11/1968 | McCoy | 5/248 |
| 3,911,511 | 10/1975 | Higgins | 5/255 |
| 4,101,993 | 7/1978 | Yates et al. | 5/267 |
| 4,112,726 | 9/1978 | Adams et al. . | |
| 4,358,097 | 11/1982 | Zapletal et al. . | |
| 4,488,712 | 12/1984 | Higgins . | |
| 4,492,298 | 1/1985 | Zapletal et al. . | |

*Primary Examiner*—Gary L. Smith
*Assistant Examiner*—Michael F. Trettel
*Attorney, Agent, or Firm*—Wood, Herron & Evans

[57] ABSTRACT

A coil spring unit having a series of coil springs connected together in column and row matrix configuration, the end loops of the coil springs being open loops that terminate in free ends, i.e., the end loops of the coil springs not being closed and knotted. The coil spring assembly method comprises forming a series of coil spring rows, each row being formed from a single continuous length of spring wire. Each intermediate spring within a row has an adjacent coil spring on one side directly connected at one end of that intermediate spring, and an adjacent coil spring on the other side directly connected at the other end of that coil spring, through use of connector sections that are part of the single continuous length of spring wire used to form that row. The pre-formed rows thereafter are connected in matrix form. After the rows have been connected in matrix configuration, the connector sections are selectively cut between adjacent springs on both sides of each intermediate spring. This results in a coil spring product having individual or separate coil springs not directly connected one with the other in which each such coil spring's end loops terminate in free ends, i.e., in which each such coil spring's end loops are not knotted in those sections where the connector sections are cut, and having adjacent coil springs directly connected one with the other in those sections where the connector sections are not cut, thereby providing a coil spring unit in which the hardness/softness deflection characteristics are selectively variable across the surface area of the unit.

10 Claims, 13 Drawing Figures

BEDDING COIL SPRING UNIT AND ASSEMBLY METHOD

This invention relates to coil springs. More particularly, this invention relates to a coil spring product and an assembly method therefor.

There are many different coil spring unit constructions known to the prior art. One basic use of coil spring products is in the bedding industry where those spring products find use as mattresses and box springs. While coil spring products known to the prior art may be of various configurations, most such products, particularly in the bedding industry, make use of a plurality of rows of coil springs interconnected in the top and bottom planes to form a column and row matrix configuration of those coil springs. The interconnection of the coil springs in matrix configuration may be by spiral lacing wire, by a welded wire grid, by individual hog rings or the like. In such prior art coil spring products, it is often the case that the coil springs within each coil row are initially separate one from the other. Thus, the separate coil springs within each row must be first aligned one with the other, and then adjacent coil spring rows must be interconnected one with the other, to fabricate the final coil spring product in the desired matrix configuration.

Heretofore, the coil springs commonly used in such prior art coil spring products, and particularly in connection with mattresses and box springs produced by the bedding industry, have generally been individual coil springs as just mentioned. Each of these individual coil springs, which must be collected together into a row before that row can be interconnected with an adjacent coil spring row, includes two spaced apart end loops that are held in a spaced apart non-deflected condition by at least one intermediate loop. Each of these individual coils is fabricated from a single length of spring wire, and that means each individual coil spring has one end of the wire that terminates in one end loop, and another end of the wire that terminates in the other end loop. The terminations or ends of the wire have been handled in the commercialized prior art by knotting or tying off those wire ends in a manner that results in or forms the closed loop end loops of each coil spring. In other words, commercialized individual coil springs of the prior art have commonly incorporated a wire knot in each end loop of each spring in order to tie off the free ends of the spring wire length from which the individual coil spring is fabricated. There have been prior art attempts to manufacture bedding products made from individual coil springs in which the end loops are left unknotted or free, but those prior art attempts have generally been commercial failures because there has never been developed any practical solutions to the problem of automatic transfer machine assembly of unknotted individual coil springs.

The existence of wire knots in each end loop of an individual coil spring causes a couple of problems when that type coil spring is used in, e.g., a mattress or box spring. The first problem is a practical cost problem. The fabrication of an individual coil spring where knots are used requires the use of more wire than is the case with individual coil springs in accord with this invention. More wire is required because at least one, if not two or three, wraps of the individual spring wire is required in order to form each knot that results in the closed end loops for the individual coil spring. And further, complex machinery is required to form the individual spring knots during fabrication of each individual spring in the first place. Both these problems result in a higher manufacture cost for coil spring units that make use of individual knotted coil springs than is the case with the coil spring unit of this invention. And whenever attempts were made to use unknotted coil springs in the manufacture of a coil spring unit, it was not possible to handle the unknotted coil springs in a machine assembly sequence because of the flexibility or floppiness or freedom of the springs' end loops which resulted in tolerance limit problems that could not be met to permit adequate machine handling on a production basis.

A second problem area of the knotted individual coil spring is that the deflection characteristics of its end loops are not nearly the same around the periphery of the closed loop end loops. The deflection characteristics of a knotted individual coil spring, when deflection is measured adjacent to or on the knot side of the end loop's periphery, is significantly harder, i.e., is significantly less, than deflection of the coil spring when same is measured on that side of the end loop opposite to the knotted side. In other words, there is a hard side of the end loops of a knotted individual spring coil, and a soft side of the end loops of a knotted individual spring coil. This, it will be understood, may cause varying deflection patterns in a coil spring product fabricated from such knotted individual spring coils, the hardness or softness deflection characteristics depending on where the deflection pressure was exerted on that product.

Accordingly, it has been one objective of this invention to provide a coil spring unit capable of machine assembly that is comprised of a plurality of coil springs positioned in a column and row matrix configuration, those coil springs not having knots in either the top or bottom loop of the spring, and those coil springs being individual or separate relative one to the other except as adjacent spring rows are connected together to maintain the matrix configuration.

It has been another objective of this invention to provide an assembly method which can be carried out by machinery on a realistic and commercially practicable basis by which a coil spring product can be made of a plurality of coil springs positioned in a column and row matrix configuration, those coil springs not having knots in either the top or bottom loop of the spring, and those coil springs being individual or separate relative one to the other except as adjacent spring rows are connected together to maintain the matrix configuration.

It has been a further objective of this invention to provide a novel coil spring product, and a novel machine assembly method by which that product can be fabricated, in which the coil spring unit is comprised of a plurality of coil springs positioned in a column and row matrix configuration, those coil springs not having knots in either the top or bottom loop of the spring, and those coil springs being individual or separate relative one to the other except as adjacent spring rows are connected together to maintain the matrix configuration, and in which each coil spring row is initially formed from a single continuous length of spring wire with adjacent coil springs on each side of an intermediate spring within a spring row being selectively individualized within that row when desired by cutting of that single continuous length wire after connection of adjacent rows in matrix configuration.

It has been still a further objective of this invention to provide a novel coil spring product, and a novel machine assembly method by which that product can be fabricated, in which the coil spring unit is comprised of a plurality of coil springs positioned in a column and row matrix configuration, those coil springs not having knots in either the top or bottom loop of the spring, and those coil springs being individual or separate relative one to the other except as adjacent spring rows are connected together to maintain the matrix configuration, and in which the hardness/softness deflection characteristics of the coil spring unit can be easily adjusted throughout the surface area thereof as desired by the manufacturer by directly connecting or disconnecting adjacent coil springs on each side of an intermediate spring within a spring row by selectively maintaining or cutting a single continuous length wire from which each coil spring row is initially formed after connection of adjacent rows in matrix configuration.

In accord with these objectives, this invention is directed to a coil spring unit having a series of coil springs connected together in column and row matrix configuration, the end loops of the coil springs being open loops that terminate in free ends, i.e., the end loops of the coil springs not being closed and knotted. The coil spring assembly method comprises forming a series of coil spring rows, each row being formed from a single continuous length of spring wire. Each intermediate spring within a row has an adjacent coil spring on one side directly connected at one end of that intermediate spring, and an adjacent coil spring on the other side directly connected at the other end of that coil spring, through use of connector sections that are part of the single continuous length of spring wire used to form that row. The pre-formed rows thereafter are connected in matrix form. After the rows have been connected in matrix configuration, the connector sections are selectively cut between adjacent springs on both sides of each intermediate spring. This results in a coil spring product having individual or separate coil springs not directly connected one with the other in which each such coil spring's end loops terminate in free ends, i.e., in which each such coil spring's end loops are not knotted in those sections where the connector sections are cut, and having adjacent coil springs directly connected one with the other in those sections where the connector sections are cut, thereby providing a coil spring unit in which the hardness/softness deflection characteristics are selectively variable across the surface area of the unit.

Other objectives and advantages of this invention will be more apparent from the following detailed description taken in conjunction with the drawings in which.

Figure 12:
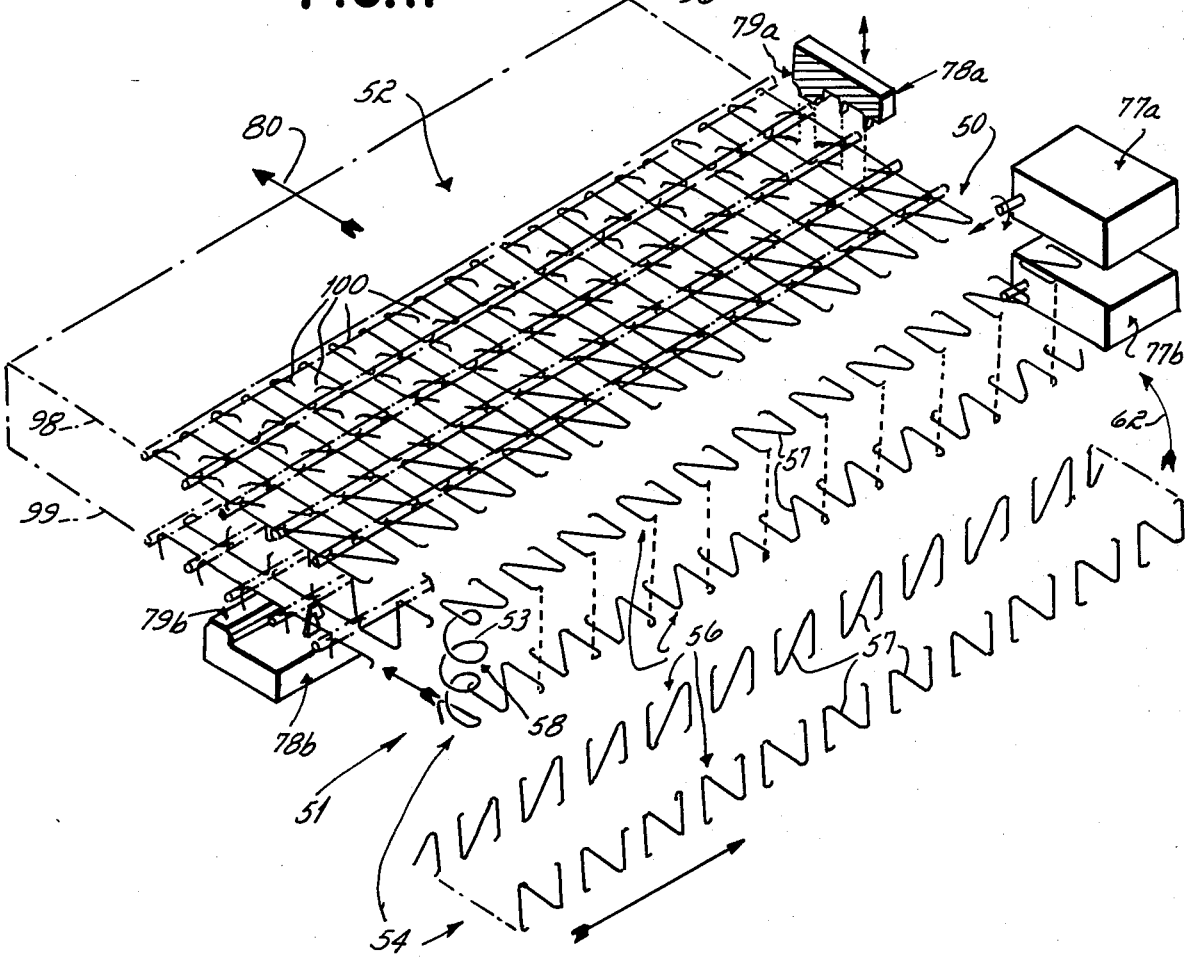
Figure 13:
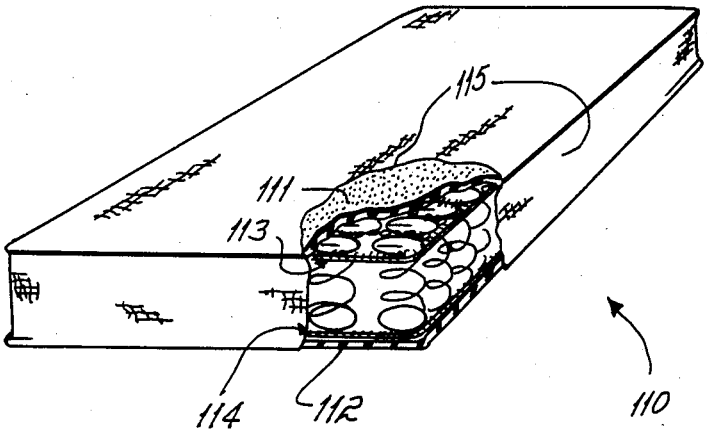

FIG. 12 is a diagrammatic perspective view of several coil spring rows laced together during the machine assembly method of this invention, a trailing coil spring row being shown in an intermediate position prior to being juxtaposed with a leading coil spring row; and FIG. 13 is a partially broken away perspective view of a bedding unit, in the form of a mattress, constructed in accord with the principles of this invention.

COIL SPRING UNIT

Figure 1:
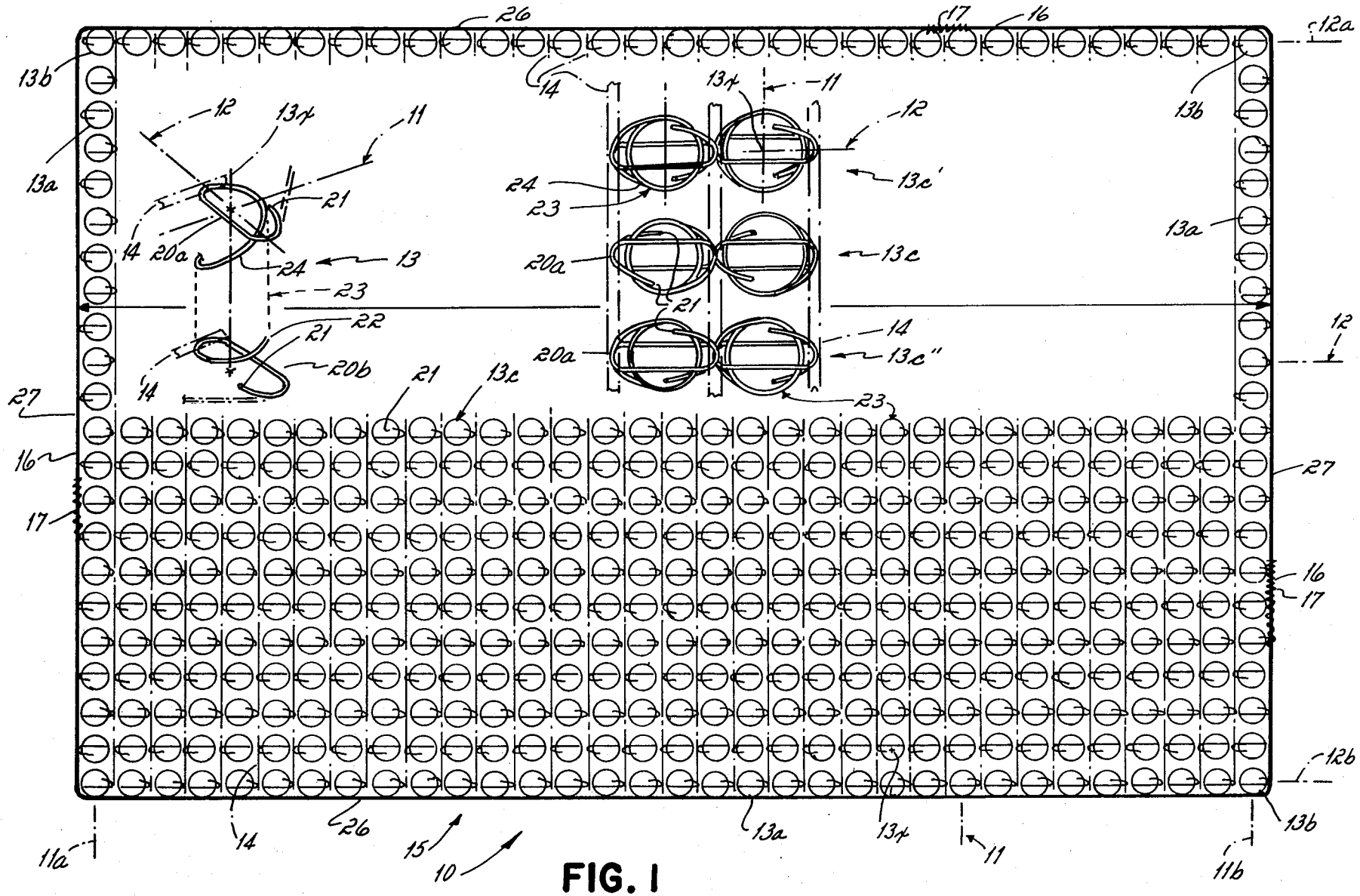
FIG. 1 is a top plan view illustrating a first embodiment of a coil spring unit fabricated in accord with the principles of this invention, fragmentary and diagrammatic insets being used to further illustrate the individual coil springs of the coil spring unit.

A first embodiment of a coil spring unit 10 in accord with the principles of this invention, and constructed in accord with the assembly method of this invention, is illustrated in FIG. 1 in detail. The coil spring unit 10 shown in FIG. 1 is for use in a mattress of the type which is commonly sold by the bedding industry. The coil spring unit 10 is comprised of a plurality of rows 11 and a plurality of columns 12. In the drawings thirty-three rows 11 and twenty-two columns 12 of coil springs 13 are illustrated. The transverse rows 11 and longitudinal columns 12 of coil springs 13 are arranged in rectangular matrix configuration with **11*a* and 11*b* denoting edge rows, and 12*a* and 12*b* denoting edge columns. Each of the edge rows 11*a*, 11*b* and edge columns 12*a*, 12*b* of coil springs 13 is comprised of a series of edge or border springs 13*a* and is terminated at each end by a corner spring 13*b*, all other springs 13*c* being intermediate springs within the matrix. Adjacent spring rows 11 are connected one with another by matrix row connectors. Preferably the matrix row connectors are in the form of spiral lacing wires 14 which extend from adjacent one end of the row to adjacent the other end of the row in known fashion in both major surface faces of the unit 10, thereby establishing the interconnected coil spring matrix. Spiral lacing wires 14 interconnect the spring rows in both the spring unit's upper face 15 (shown in FIG. 1) as well as in the unit's lower face (not shown). A border wire 16 is connected to the coil spring matrix in both the upper face 15 and lower face (not shown) thereof. The border wire 16 is of a closed or endless loop configuration, and this closed loop is of a rectangular geometry analogous to the outer periphery of the coil spring matrix when that matrix is viewed from a line of sight normal to a face of the matrix. The border wire 16 preferably is of a heavier gauge than the spring wire from which the coil springs 13 are fabricated. The border wire 16 is fixed to the edge 13***a* and corner 13*b* border springs of the coil spring matrix by border wire connectors. Preferably the border wire connectors are also in the form of spiral lacing wire 17.

The coil springs 13 themselves which comprise the spring matrix of spring unit 10 are each in the form of spiral springs as shown in FIG. 1 and the isometric inset. Each of the coil springs 13 presents an end face loop 20 in each face of the coil spring unit 10, i.e., in both upper 15 and lower (not shown) faces of the unit; in FIG. 1, note particularly the enlarged section and the perspective insets of FIG. 1 that illustrate the face loops in greater detail. It is these face loops 20 of coil springs 13 in adjacent rows 11 that are interconnected one with another by spiral row lacing wires 14, and it is these face loops of edge 13*a* and corner 13*b* springs which are connected with the border wire 16, in order to establish and maintain the matrix configuration of the coil spring unit 10. As noted, each coil spring is comprised of a top end face loop 20*a* and bottom end face loop 20*b*, both end face loops being oriented generally perpendicular to the spring's longitudinal axis 13*x*. The top 20*a* and bottom 20*b* face loops are both interconnected with one another through use of at least one intermediate spiral loop 24. The intermediate spiral loop 24 defines the barrel 23 of the coil spring as shown in FIG. 1.

Note particularly that each of the end face loops 20 of a coil spring 13 is an incomplete, i.e., unclosed loop. And note further, and most importantly relative to this invention, that each of the face loops 20 defines a free end 21 which is not knotted or otherwise tied back onto any other portion of the spring wire 22 from which the coil spring 13 is formed. This is the important feature of the coil spring unit 10 of this invention in that it insures each intermediate coil spring 13*c* is individual, i.e., separate and apart, relative to its adjacent coil spring 13*c*', 13*c*'' on either side thereof except as those coil springs are interconnected one with the other in matrix configuration by the matrix lacing wires 14. And this results in the important advantages of applicant's coil spring unit 10 relative to coil spring products fabricated from individual knotted coil springs (not shown), namely, less spring wire is used in manufacture of the unit 10, and the unit itself can be machine made by a novel assembly method explained below. Also importantly relative to this invention, the free ends 21 of the face loops 20 of each coil spring 13 are inwardly directed or formed into the barrel 23 of that coil spring. In other words, the free ends 21 of the face loops 20 of each coil spring 13 are deformed so that same point inwardly into the barrel 23 interior of the coil spring 13 as defined by intermediate loops 24 of that coil spring. This termination configuration of the free ends 21 of each coil spring's face loops insures that those ends do not rip or tear any covering material (e.g., padding and cloth covering) which envelopes the coil spring unit 10 when it is subsequently processed into a finished mattress available for consumer purchase. Further, the individual coil spring unit 10 of this invention provides the desirable flexure characteristics of a unit fabricated from individual coil springs without the cost and flexure problems associates with prior art knotted individual coil springs.

The first embodiment of the coil spring unit 10, which is illustrated in FIG. 1, is in the form of a product in which all coil springs 13 of each row 11 are individual and separate relative one to the other, i.e., are not directly connected one to the other. This provides a coil spring unit with relatively constant flexure characteristics between side edges 26 and between end edges 27 thereof, i.e., at substantially any surface 15 location within the periphery of the mattress' border wire 16. The second embodiment 30 of the coil spring unit of this invention, as illustrated in FIG. 2, is different and distinct from the embodiment 10 shown in FIG. 1 in that the flexure characteristics of the coil spring rows 11 varies between end edges 27 of the unit, i.e., varies within any given column 12 between end edges 27 of the unit, but is consistent within any given row 11 between side edges 26 of the unit.

Figure 2:
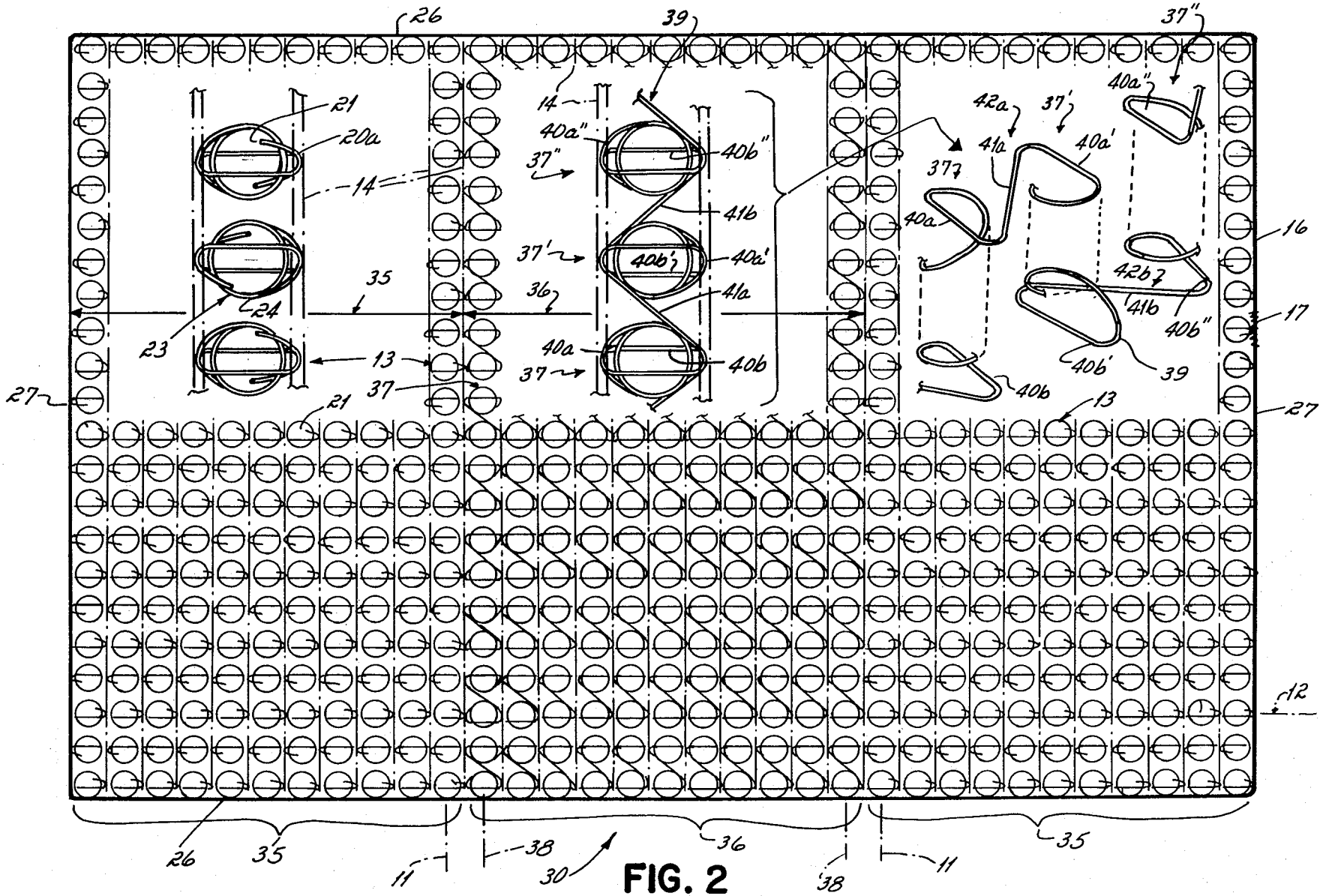
FIG. 2 is a view similar to FIG. 1, but illustrates a second embodiment of a coil spring unit fabricated in accord with the principles of this invention, fragmentary and diagrammatic insets being used to further illustrate the continuous coil spring configuration and individual coil springs of the coil spring unit.

The second embodiment of a coil spring unit 30 in accord with the principles of this invention, and constructed in accord with the assembly method of this invention, is illustrated in detail in FIG. 2. This second embodiment also is for use in a mattress of the type which is commonly sold by the bedding industry. In describing this second coil spring unit 30, identical reference numerals are used where the parts in this second embodiment are identical to the analogous parts in the first or FIG. 1 embodiment. The coil spring unit 30 includes two end sections 35 spaced apart one from the other by a middle section 36, the middle section comprising one third of the unit length and each of the end sections comprising one third of the unit length. The individual coil springs 13 used in the two end sections 35 of this second spring unit 30 are identical in structure to those coil springs described above in connection with the first spring unit 10 embodiment. It is the structure of the coil springs 37 in the rows of the middle section 36 of this second spring unit 30, however, that significantly differs from the structure of the coil springs 13 in the rows 11 of the first spring unit 10.

The coil springs 37 of each row 38 in middle section 36 of the second spring unit 30 are formed from a single continuous length 39 of spring steel wire. Accordingly, adjacent pairs of coils 37 are connected alternately at their face loops 40*a* on the top side and at their face loops 40*b* on the bottom side. Specifically, and as best seen at the isometric inset of FIG. 2, the upper face loops 40*a* and 40*a*' of adjacent coils 37 and 37' are joined by connector segment 41*a* to form a Z-shaped connector section 42*a* at the upper surface of the coil row. And a connector segment 41*b* joins lower face loops 40*b*' and 40*b*'' of adjacent coils 37' and 37'' to form a similar Z-shaped connector section 42*b* at the lower surface of the coil row. This alternating upper, then lower, connection of the adjacent coils 37 is continuous from one side 26 to the other side 26 of the unit 30 for all rows 38 within section 36. This results in a row 38 of coil springs 37 each of which is directly connected to its adjacent coil springs within that row by connector segments 41. The continuous coil rows 38 of the middle section 36 connected one with the other by connecting the end face loops 40*a*, 40*b* of the coils 37 within each row connected to the end face loops of the coils within adjacent rows 38, or to the end face loops 20*a*, 20*b* of the individual coils 13 within the unit's end sections 35, as the case may be, by a lacing wire to establish the matrix configuration of the spring unit 30. This results in coil spring rows 38 with directly connected (as opposed to individual or separate) coil springs 37 that are interconnected one with the other through use of spiral lacing wire 14 to establish the matrix configuration of the middle section 36 of the unit 30. It will be understood that the continuous coil row 38 described here is identical with the one illustrated and discussed in the assembly method of this invention.

Since the coil springs 37 within each of the rows 38 of middle section 36 of the spring unit 30 are directly connected with their adjacent coil springs by connector segments 42, the firmness of this middle section is significantly greater than the firmness of the unit's two end sections 35. And in a mattress environment, this may be considered very desirable to some consumers because it is well known that the center section 36 of a mattress normally bears the heaviest weight load of a person lying on it. Accordingly, this second or FIG. 2 embodiment of a coil spring unit 30 possess flexure characteristic variability within a coil spring unit 10 fabricated in accord with the principles of this invention in that the coil springs 13, 37 within each row 11, 38 may be either individual or separate relative one to the other (as in rows 11), or may be directly connected relative one to the other (as in rows 38), as desired by the fabricator in order to produce the desired firmness/softness to the end user. And in all cases, i.e., whether the coil springs 13, 37 are separate one from the other within each row as in rows 11 or are connected together by connector segments 42 one to the other within each row as in rows 38, there are no knots of any kind used in fabrication of the coil spring unit 30.

Both of the first 10 and second 30 coil spring units are adapted for use as a bedding product in the form of a mattress 110 as shown in FIG. 13. The mattress 110 includes the coil spring unit 10 or 30, padding 111, 112 which overlies the upper 113 and lower 114 surfaces of the unit, and an upholstery envelope 115 which encloses the coil spring unit and padding into a finished mattress product for eventual distribution to a retail consumer.

Assembly Method

The machine assembly method for the coil spring units 10, 30 of FIGS. 1 and 2 is illustrated in FIGS. 3–12 in diagrammatic form. The operation of the machine assembly method shown in those figures is illustrated in connection with leading 50 and trailing 51 coil rows, and a partially formed spring unit 52. Herein used, the term leading row refers to the last row laced to a partially formed spring unit and the term trailing row refers to the next row to be connected to the partially formed unit. It should be understood that each of the spring coils 53 shown in FIGS. 3–12 represents a row of such coils.

Each row of spring coils 53 initially comprises a continuous coil spring row 54 manufactured by the machine and method shown in Adams et al U.S. Pat. No. 4,112,726, assigned to the assignee of this invention, see FIG. 12. The disclosure of Adams et al U.S. Pat. No. 4,112,726 is incorporated herein by reference. Each continuous spring row 54 is formed from a single continuous length of spring wire (not shown) that is shaped into a continuous length spiral or helix (not shown) which is folded into a wave configuration or row 54 for establishing the plurality of individual spring coils 53 disposed generally parallel one to another, see FIG. 12. Each coil 53 in the row 54 is connected at its opposite ends to adjacent coils on either side thereof by connector sections 56. The connector sections 56 are preferably formed in a planar Z-shaped configuration such that the formed connector sections at the same ends of the coils are disposed in a common plane normal to the axes 53*a* of the coils which they interconnect. Each connector section 56 partially defines the end face loop for the two adjacent coils 53 it connects, as well as a connector segment 57.

The machine assembly method of this invention includes certain steps that can be carried on by a machine disclosed in detail in Zapletal et al U.S. patent application Ser. No. 300,995, filed Sept. 10, 1981, and assigned to the assignee of this application. The disclosure of Zapletal U.S. patent application Ser. No. 300,995 is incorporated herein by reference. The machine assembly method of this invention commences with a continuous coil spring row 54 as a feedstock to pick up fingers 60 pivotable through a 90° arc on pivot axis 61 as shown by arrow 62, and a support platen 63 which defines a horizontal spring support plane 64 relative to ground 65. A sizing platen 66 is located parallel to and above the support platen 63. A compression bar 67 is vertically reciprocable as shown by arrow 68 relative to the support plane 64. Upper 69*a* and lower 69*b* transfer fingers, rotatable on upper 70*a* and lower 70*b* transfer axes in the direction shown by arrows 71*a*, 71*b*, cooperate with compression bar 67 and platens 63, 66. Upper 72*a* and lower 72*b* clamping dies pivotable as shown by arrows 74*a*, 74*b*, upper 73*a* and lower 73*b* indexing hooks reciprocable as shown by arrows 75*a*, 75*b*, and a feed-out mechanism 76 (see FIG. 11) also cooperate with the platens 63, 66. Upper 77*a* and lower 77*b* matrix lacing wire mechanisms cooperate with the clamping dies 72*a*, 72*b*. And importantly relative to the machine assembly method of this invention, upper 78*a* and lower 78*b* cutters, and upper 79*a* and lower 79*b* formers are located upstream of the feed out mechanism 76, but downstream of the clamping dies 72 and matrix lacing mechanism 77, relative to the machine direction 80 of the assembly method step sequence. The cutters 78 and formers 79 are vertically reciprocable as shown by arrows 59*a*, 59*b*.

Figure 3:
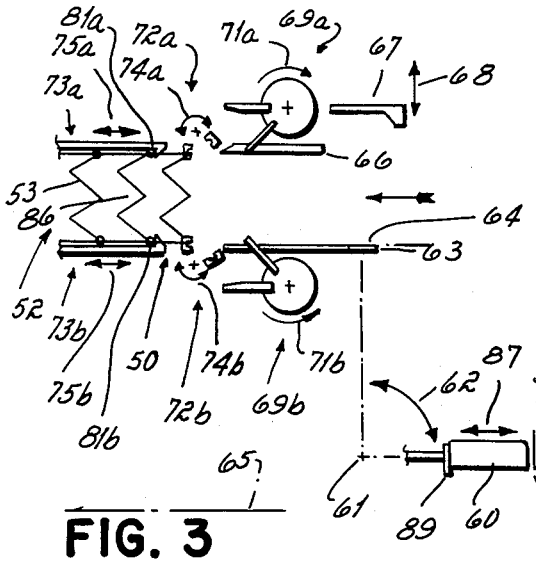
FIG. 3 is a side diagrammatic view of a first step in a machine assembly method in accord with the principles of this invention, the step being illustrated with a partially formed coil spring unit, and with the method sequence in the ready position prior to commencing a new cycle.

The cycle start position of the machine assembly method of this invention is shown in FIG. 3 at which a continuous wire leading spring row 50 has been previously connected to downstream interconnected spring rows 53 by upper 81*a* and lower 81*b* spiral lacings, the machine direction of the spring rows and spring unit through the method step sequence being illustrated by arrow 80. In this cycle ready position, and as shown in FIG. 3, the compression bar 67 is in its retracted or upper position, and the rear dies of the upper 72*a* and lower 72*b* dies are in their active position. In this active position, the rear dies 85 function as stops so as to position the leading coil row 50 in the desired lacing position relative to the trailing coil row 51 that will be subsequently received in juxtaposed relation with that leading coil row within the dies 72. Further in this cycle ready position, note that the indexing hooks 73 are in a retracted position at which same grip the previously laced upper and lower lacing wire 81 connections between the leading spring row 51 and the adjacent downstream interconnected spring row 86. This interconnection of the upper 73*a* and lower 73*b* indexing hooks with the downstream coil spring unit insures that the upper 39*a* and lower end face loops 56 of the leading spring row 50 are drawn taut against and properly positioned within the rear dies 85 of the upper 72*a* and lower 72*b* dies.

Figure 4:
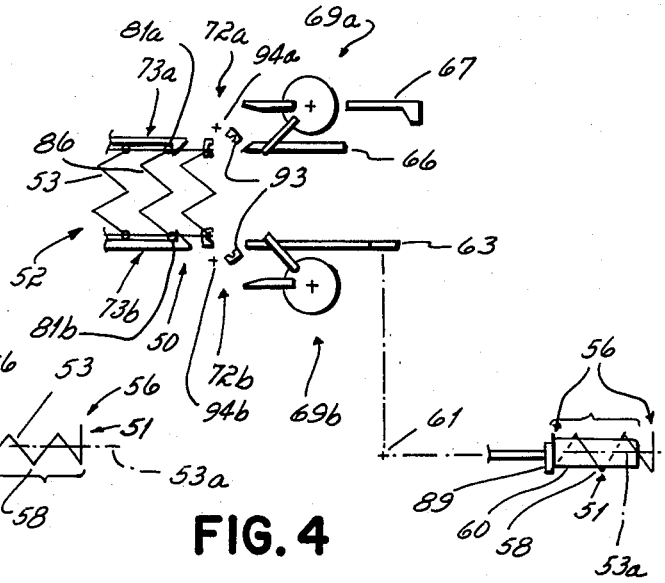
FIG. 4 is a view similar to FIG. 3 illustrating a first step in the assembly cycle at which pickup fingers are initially inserted into the spring barrels of a trailing coil spring row at an infeed location.
Figure 5:
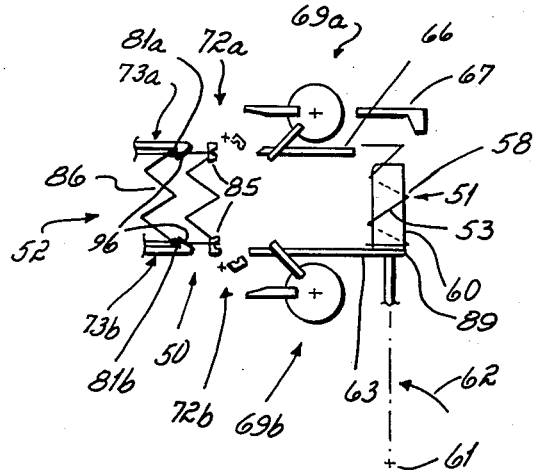
FIG. 5 is a view similar to FIG. 4 showing the next step in the assembly cycle at which the trailing coil spring row has been moved from the infeed location to a preliminary location on a support platen.

With the machine assembly sequence in the cycle start position as shown in FIG. 3, the initial assembly step is to extend the pick up fingers 60 in direction 87 from the retracted FIG. 3 position into the extended FIG. 4 position. In the pick up fingers' extended FIG. 4 position, each pick up fingers, which are in the form of a narrow blade, is received and positioned within barrel 58 of a coil spring row 54 in the pick up or infeed position of the trailing spring row 51. Note this initial pick up or infeed position of trailing spring row is with spring axes disposed parallel to the support platen's plane 64. After the pick up fingers are received within the coil springs' barrels as shown in FIG. 4, the pick up fingers are pivoted through a 90° arc (as shown by arrow 62) about pivot axis 61 until the pick up fingers' base 89 is located against a recessed seat defined in the support platen 63 as shown in FIG. 5. In this FIG. 5 position, the coil springs' axes are oriented perpendicular to the support platen's plane 64, and the trailing spring row 51 is seated on that support platen 63.

Figure 6:
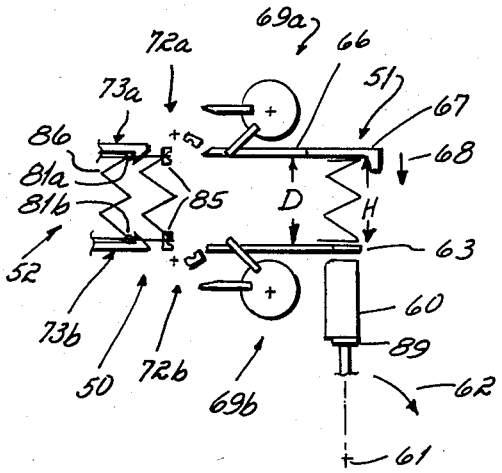
FIG. 6 is a view similar to FIG. 5 illustrating the next step in the assembly cycle at which the pickup fingers are withdrawn and a compression bar is lowered for height sizing of the trailing coil spring row.
Figure 7:
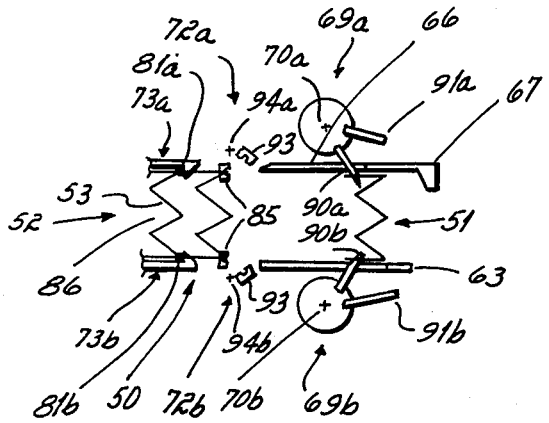
FIG. 7 is a view similar to FIG. 6 illustrating the following step in the assembly cycle at which the trailing coil spring row has been pulled from beneath the compression bar, and directed between a sizing platen and the support platen by an advancing mechanism.

Once the trailing coil spring row 51 is in the FIG. 5 position where it is seated on the support platen 63, and while pick up fingers 60 still remain in the coil springs as shown in FIG. 5, the compression bar 67 is extended (as shown by arrow 68) in a direction normal to the support platen's plane 64 into compressive relation with the top end face loops 56 of the coil springs. The full extended position of the compression bar 67, which is shown in FIG. 6, is such that the height H of the coil springs is established at a predetermined and desired height, which height is no greater than the distance D between the sizing platen 66 and the support platen 63. After the compression bar 67 has been lowered, the pick up fingers 60 are withdrawn from the coil springs' barrels so that the coil springs are, in effect, restrained in position on the support platen 63 by the compression bar 67. With the compression bar 67 still in extended position relative to the trailing coil spring row 51, and with the pick up fingers 60 withdrawn from the springs' barrels (and pivoted back per direction arrow 62 to the pick up position shown in FIGS. 3 and 4), the spring row advancing mechanism 69 is activated in the assembly method cycle.

Figure 8:
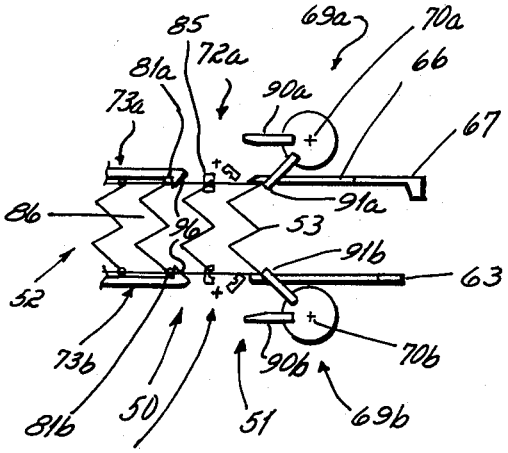
FIG. 8 is a view similar to FIG. 7 but illustrating the trailing coil spring row being pushed into juxtaposed proximity with the leading coil spring row by the spring advancing mechanism.

The spring row advancing mechanism 69 includes a top set 90 of transfer fingers and a bottom set 91 of transfer fingers for cooperation with the top end face loops 56 and bottom end face loops 56, respectively, of the trailing coil spring row 51. These transfer fingers 90, 91 rotate on rotational axes 70*a*, 70*b* positioned above and below, respectively, the sizing platen 66 and support platen 63 in such a position that the fingers themselves extend through slots (not shown in the figures) in the sizing and support platens, respectively. As the transfer fingers 90, 91 are rotated from the FIG. 6 position to the FIG. 7 position, the leading transfer finger 90*a*, 91*a* of each set initially moves into the coil springs' barrels and engages the leading edges of the trailing coil springs' top and bottom end face loops 56, thereby pulling the coil spring row 51 in machine direction 80 out from underneath the compression bar 67 and into an intermediate advanced position between the sizing platen 66 and the support platen 63. Subsequently, and as the transfer fingers 90, 91 continue to rotate from the FIG. 7 position to the FIG. 8 position, the trailing transfer fingers 90*b*, 91*b* of each set engages the trailing edges of the trailing springs' top 39*a* and bottom 39*b* end face loops, thereby pushing the coil spring row 51 in machine direction 80 between the sizing platen 66 and the support platen 63 towards and into juxtaposition with the leading spring row 50 already located within the clamping dies 72. In other words, and as the trailing coil spring row 51 is moved toward the FIG. 8 attitude from the FIG. 7 position, the trailing transfer fingers 90*b*, 91*b* push that coil spring row toward the clamping dies 72 until the leading edges of the trailing springs' top and bottom end face loops 56 abut against the top and bottom rear dies 85 as shown in FIG. 8. This initial pulling and subsequent pushing of the trailing coil spring row 51 from beneath the compression bar 67 between the sizing platen 66 and support platen 63, and into juxtaposed relation with the leading coil spring row 50 at the clamping dies 72, insures that the trailing spring row will be firmly and positively advanced into the upper 72*a* and lower 72*b* clamping dies.

Figure 9:
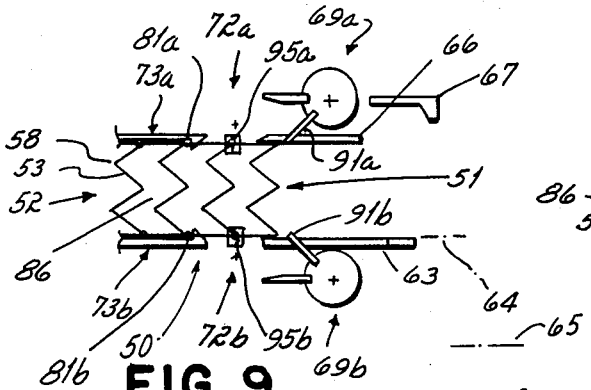
FIG. 9 is a view similar to FIG. 8 illustrating the next step in the assembly cycle at which the leading and trailing coil spring rows have been clamped together by clamping dies while juxtaposed end loops of the juxtaposed coil springs are laced together.

When the trailing spring row 51 has been juxtaposed to the leading spring row 50 by the advancing mechanism 69 as shown in FIG. 8, the upper 72*a* and lower 72*b* clamping dies' front dies 93 rotate on upper and lower dies axes 94 (as shown by arrows 74*a*, 74*b*) into clamping relation with the respective rear dies 85. In this clamping position, which is shown in FIG. 9, the upper 72*a* and lower 72*b* clamping dies are closed, thereby properly positioning and clamping together the juxtaposed upper and lower end face loops 56 of the leading 50 and trailing 51 coil spring rows. In this die closed position, the end loops 56 of the juxtaposed leading 50 and trailing 51 coil spring rows are laced together by upper 81*a* and lower 81*b* spiral lacing wire as shown in FIG. 12 so as to interconnect or tie the leading spring row 50 to the trailing spring row 51. The spiral lacing wire mechanism 77*a*, 77*b* used to achieve the matrix lacing step is disclosed more particularly in Aronson patent application Ser. No. 300,813, filed Sept. 10, 1981, and assigned to the assignee of this application. The disclosure of Aronson patent application Ser. No. 300,813 is incorporated herein by reference. Note as shown in FIG. 9 that, during the lacing step, upper 73*a* and lower 73*b* indexing hooks remain retracted and interengaged with the previously laced upper 81*a* and lower 81*b* connections between the leading spring row 50 and the coil spring row 86 immediately downstream therefrom.

Figure 10:
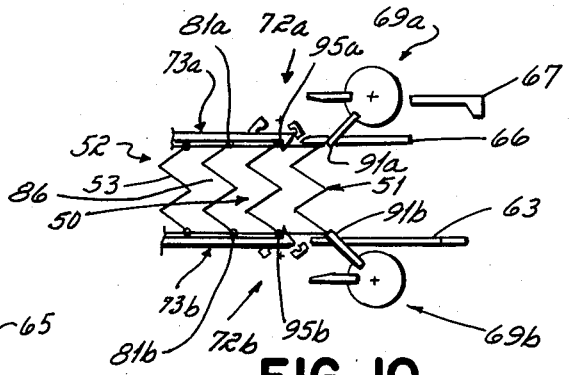
FIG. 10 is a view similar to FIG. 9 showing the following and last step in the assembly cycle at which indexing hooks are extended for gripping the coil spring product, the cycle returning to the FIG. 3 position until a completed coil spring unit is made.

After the leading coil spring row 50 and trailing coil spring row 51 have been laced together with the spiral lacing wires 81*a*, 81*b*, thereby connecting the two spring rows together, both dies 85, 93 of the upper 72*a* and lower 72*b* clamping dies pivot out of clamping relation with those spring rows on upper and lower die axes 94. This, in effect, removes both dies 85, 93 of each of the upper 72*a* and lower 72*b* clamping dies from the space between the sizing platen 66 and the support platen 63 so as to permit the assembled coil spring unit 52 to be indexed in the machine direction 80. This indexing of the coil spring unit 52 in the machine direction 80 is achieved by extending the indexing hooks 73 into hooked relation with the spiral lacing wire connections 95*a*, 95*b* that have just joined the leading 50 and trailing 51 spring rows as shown in FIG. 10. In this extended attitude, the indexing hooks 73 simply grab the lacing wire 95*a*, 95*b* and/or the springs' end face loops 56. The indexing hooks 73 are thereafter retracted in the machine direction 80 from the FIG. 10 extended position back into the FIG. 3 retracted position. As the indexing hooks 73 are retracted, and prior to achieving the full retracted position shown in FIG. 1, the rear dies 85 of each of the upper 72*a* and lower 72*b* clamping dies is pivoted on its respective axis 94 back into the stop or closed position shown in FIG. 3. In this subsequent position, and as noted in connection with FIG. 5, the upper and lower rear dies 85 cooperate with the indexing hooks 73 to properly position the end loops 56 of the new leading spring row (which was the previous trailing spring row) in that position shown in FIG. 3 preparatory to receiving a new or subsequent trailing spring row. With regard to the indexing hooks 73, note that the trailing edges 96 of each is, in effect, a cam edge so as to permit the hooks to extend beyond the laced connection 95*a*, 95*b*, i.e., upstream of that laced connection, when they are moved from the retracted FIG. 9 position back to the extended FIG. 10 position, without catching on the lacing wires 95*a*, 95*b* or the coil springs' end face loops 56.

Figure 11:
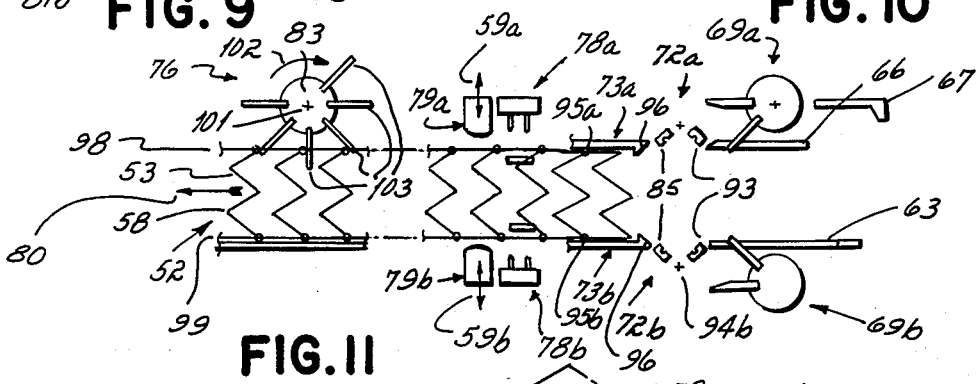
FIG. 11 is a step following the step of FIG. 10, and illustrating the operation of a feed out mechanism after a coil spring unit has been completed.

The important step of the assembly method in accord with the principles of this invention is the next step in the method sequence of fabricating a coil spring product 10 or 30. In this next step, which is illustrated in FIGS. 11 and 12, the coil springs 53 within each continuous coil spring row 54 are selectively individualized, as desired by the manufacturer. Individualization of the coil springs 53 in each continuous coil spring row 54, which coil springs have heretofore during the assembly method step sequence been directly connected one with the other through use of connector segments 57 that form part of Z-shaped end connector sections 56, is achieved through use of upper 78*a* and lower 78*b* cutters. The series of cutters 78 are positioned transverse to the machine direction 80 with a single cutter being positioned between each adjacent pair of coil springs 53. The series of cutters 78 are located both above the top plane 98 of the coil spring unit 52, and below the bottom plane 99 of the coil spring unit. If individualized coil springs (as for example the springs 13 of unit 10) are desired throughout any given coil spring row 54, or only in sections of a given coil spring row 54, the selected cutters 78 are reciprocated from a non-cutting or storage position to a cutting position as shown by arrows 59. The cutters 78 are positioned so they are reciprocatable into cutting relation relative to the connector segment 57 of each Z-shaped end connector section 56. If individualized coil springs are desired, then the cutter heads are reciprocated into cutting position (not shown) at which those connector segments 57 are cut and removed from the Z-shaped end connector sections 56. This cut out step effectively individualizes or separates adjacent coil springs 53 that were previously directly connected one with the other. And it is this cut out step that permits individualization of the coil springs 53 within a previously continuous coil spring row 54 in the final coil spring product 10 or 30. Note particularly that this cutting step in the machine assembly method sequence of this invention is not carried out, and may not be carried out, prior to interconnection of adjacent continuous coil spring rows 50, 51 one with the other through use of, e.g., spiral lacing wires 81*a*, 81*b* as shown. In other words, it is quite important, relative to the merits of this invention, that the coil spring rows 50, 51 formed of a single continuous length spring wire be interconnected one with the other in matrix configuration through use of, e.g., spiral lacing wires 81, before the cutting step is carried out. The important point here is that to individualize any given intermediate coil spring 53 relative to its adjacent springs 53 on either side, the Z-shaped connector segment 57*a* at its top plane 98 that connects it with one adjacent spring must be cut, and the Z-shaped connector segment 57*b* at its bottom plane 99 which connects it with its other adjacent coil spring also must be cut. In other words, the Z-shaped connector segments 57 on both the top 98 and bottom 99 planes of the coil spring unit must be cut in order to individualize all intermediate coil springs within a given coil spring row 54 relative one to the other, i.e., in order to eliminate direct connection of those springs 53 one with the other through use of previously present Z-shaped end connector sections 57.

Once the cutting step is carried out, upper 79*a* and lower 79*b* formers are then reciprocated from a storage position shown in FIGS. 11 and 12 into a forming position (not shown) in order to bend the free ends 100 of the end face loops 56*a*, 56*b* of the individualized coil springs 53 inwardly toward the center of those coil springs' barrels. This forming step is important because the free ends 100 of the coil springs' end face loops 56 would be sharp and tend to catch on whatever covering materials, e.g., padding and fabric, is subsequently laid over a completed coil spring unit in transforming it into a finished saleable product, e.g., a mattress as shown in FIG. 13.

It is important to note, relative to this cutting step in the machine assembly method step sequence, that if all successive coil spring rows 54 are cut so as to individualize all coil springs 53 within each row, then a coil spring unit 10 in accord with FIG. 1 will be produced. On the other hand, and if alternate sections of eleven rows 54 are cut and not cut, then a finished coil spring unit 30 in accord with the FIG. 2 embodiment is formed.

After the desired number of coil spring rows 50, 51 have been laced together in the coil spring unit 52 to be fabricated, and as shown in FIG. 11, the machine's upper 72*a* and lower 72*b* clamping dies are both retracted or pivoted into the unactive position. The feed-out mechanism 76, which is in the form of a feed-out wheel 83 is then rotated or cycled on axis 101 in direction 102 through a single revolution. While the feed-out wheel 83 is rotated, the successive fingers 103 on the wheel enter the barrels of successive coil springs 53 in the coil spring unit 52, thereby causing the coil spring unit to move in the machine direction 80 away from the clamping dies 72, away from the indexing hooks 73, and away from the cutters 78 and formers 79. This feed-out wheel 83, therefore, cycles only after a full coil spring unit 10 or 30 has been completed so as to at least partially remove that spring unit from the machine by sliding it along support platen 63. This, in turn, makes final removal from the machine of the coil spring unit (i.e., a spring matrix configuration shown in FIGS. 1 or 2 or otherwise) easy for an operator, and also insures that the clamping dies 72, indexing hooks 73, and cutter 78 and former 79, areas of the machine are cleared preparatory to commencing the operation sequence for fabricating another coil spring unit.

Having described in detail the preferred embodiment of my invention, what I desire to claim and protect by Letters Patent is:

1. A bedding product comprising a series of coil springs disposed in column and row matrix configuration, said rows being interconnected together one with the other in order to maintain said matrix configuration, and each of said coil springs having opposed end face loops connected by at least one intermediate loop, a first section of said coil springs in which at least one of said coil springs within a given row is an individualized coil spring separate and apart from those coil springs adjacent thereto except as said rows are interconnected one with the other, said end face loops of each of said individualized coil springs including a free end not knotted to the coil spring wire from which said spring is formed so that, in effect, said end face loops of said individualized coil springs are defined by an open segmented loop configuration, a second section of said coil springs in which at least two of said coil springs within a given row are directly connected one to the other, said two coil springs being formed from a single continuous length of spring wire that defines both said coil springs as well as a connector section that directly connects both said coil springs, padding that overlies at least one end loop face of said coil spring matrix, and upholstery that overlies said padding to provide said finished bedding product.

2. A coil spring unit, said coil spring unit comprising a series of coil springs disposed in column and row matrix configuration, said rows being interconnected together one with the other in order to maintain said matrix configuration, and each of said coil springs having opposed end face loops connected by at least one intermediate loop, a first section of said coil springs in which at least one of said coil springs within a given row is an individualized coil spring separate and apart from those coil springs adjacent thereto except as said rows are interconnected one with the other, said end face loops of each of said individualized coil springs including a free end not knotted to the coil spring wire from which said spring is formed so that, in effect, said end face loops of said individualized coil springs are defined by an open segmented loop configuration, and a second section of said coil springs in which at least two of said coil springs within a given row are directly connected one to the other, said two coil springs being formed from a single continuous length of spring wire that defines both said coil springs as well as a connector section that directly connects both said coil springs, 3. A coil spring unit as set forth in claim 2, the free ends of each coil spring being directed inwardly into the barrel interior of the coil spring.

4. A coil spring unit as set forth in claim 2, the end face loops at one end of said coil springs being in a common plane generally normal to the spring axes for defining a first surface of said unit, and the end face loops at the other ends of said coil springs being in a common plane generally normal to said spring axes to define a second surface of said spring unit.

5. A coil spring unit as set forth in claim 2, all of said coil springs in said first section being individualized so that same are separate and apart from those coil springs adjacent thereto except as said rows are interconnected one with the other.

6. A coil spring unit as set forth in claim 5, said matrix configuration being in the form of a bedding product.

7. A coil spring unit as set forth in claim 5 wherein all of the coil springs within a given row in said second section are directly conected to the adjacent coil springs within the same row.

8. A coil spring unit as set forth in claim 2, a portion of said rows having individualized coil springs, and a portion of said rows having the end face loops of adjacent coil springs directly connected one to the other.

9. A coil spring unit as set forth in claim 8, said matrix configuration being in the form of a bedding product.

10. A coil spring unit as set forth in claim 9, said bedding product comprising a center section of rows in which the end face loops of adjacent intermediate coil springs are directly connected one with the other so that said coil springs are not individualized, and at least one end section of rows in which all of said coil springs are individualized so that said coil springs within said end section are separate and apart from one another except as said rows are interconnected with one another.

* * * * *